US005502872A

United States Patent [19]

Chae et al.

[11] Patent Number: 5,502,872

[45] Date of Patent: Apr. 2, 1996

[54] ELECTRIC VACUUM CLEANER HAVING STEAM DISCHARGE AND CLOTH WIPER

[75] Inventors: Hee-Gwon Chae; Sung-Su Park, both of Seoul, Rep. of Korea

[73] Assignee: Samsung Electronics Co., Ltd., Suwon, Rep. of Korea

[21] Appl. No.: 246,292

[22] Filed: May 19, 1994

[30] Foreign Application Priority Data

May 19, 1993 [KR] Rep. of Korea ..... 1993-8570
Jun. 7, 1993 [KR] Rep. of Korea ..... 1993-9815 U

[51] Int. Cl.[6] ..... A47L 7/04

[52] U.S. Cl. ..... 15/320; 15/346; 15/353

[58] Field of Search ..... 15/320, 321, 322

[56] References Cited

U.S. PATENT DOCUMENTS 1,801,135 4/1931 Blogg ..... 15/320
1,803,693 5/1931 Cutting ..... 15/320
3,755,850 9/1973 Porter ..... 15/320
4,369,544 1/1983 Parisi ..... 15/320
4,696,074 8/1987 Cavalli ..... 15/321
5,341,541 8/1994 Sham ..... 15/320
5,400,462 3/1995 Amoretti ..... 15/321

*Primary Examiner*—Chris K. Moore
*Attorney, Agent, or Firm*—Burns, Doane, Swecker & Mathis

[57] ABSTRACT

An electric vacuum cleaner delivers clean water from a water supply tank to a steam generator and atomizes the water with air received from a suction generator. The steam generator converts the atomized water into steam, and the steam is discharged onto the floor through a suction head. The suction head carries a movable cloth for wiping the floor. Dirt, steam and air are sucked up through the suction head and delivered to a dirt collector where the dirt, air, and water (condensed steam) are separated from one another.

12 Claims, 12 Drawing Sheets

ELECTRIC VACUUM CLEANER HAVING STEAM DISCHARGE AND CLOTH WIPER

BACKGROUND OF THE INVENTION

1. Field of the Invention

The present invention relates to an electric vacuum cleaner, and more particularly to an electric vacuum cleaner for obtaining an increased cleaning efficiency by cleaning with ejected steam generated from an inside of a body of the cleaner.

2. Description of Prior Art

A conventional up-right electric vaccum cleaner, as illustrated in FIG. 1, comprises: a fan motor 2 disposed on a lower side of the body 1 for generating suction force according to operation of the cleaner; a dust collecting pouch 4 disposed on an upper side of the fan motor 2 for collecting dust sucked in through a suction hose 3; a brush 5 disposed on the lower side of the body of the cleaner for being rotated according to operation of the fan motor 2; and a suction head 6 disposed on the lower side of the body of the cleaner for sucking dust into a duct collecting couch 4.

Furthermore, a cover 7 is fitted to a front of the body 1 of the cleaner, so that the same can be opened and closed for change of the dust collecting pouch 4, and a plurality of exhaust holes 8 are formed on a lower side of the cover 7 in order to discharge sucked air to an outside of the body 1.

Accordingly, when strong suction force is generated within the body 1 of the cleaner according to the operation of the fan motor 2, the air along with the dust sucked into the suction port 6*a* by operation of the brush 5 is dispatched to the dust collecting pouch 4 through the suction hose 3, and only the air purified by passing through the dust collecting pouch 4 is discharged to the atmosphere through an exhaust port 8 while the dust is collected inside the dust collecting pouch 4 because the same cannot pass through the pouch 4.

As seen from the foregoing, the dust, wastes or the like can be collected by the conventional technique to a degree, however there has been a problem in that stains absorbed into a floor, old dirts or the like cannot be cleaned, thus decreasing the cleaning efficiency markedly and causing inconveniences thereby calling for a separete wiping with a damp cloth and the like.

Recently, an electric vacuum cleaner has been disclosed which can wipe the floor with the damp cloth by being supplied with cleaning water stored in the body of a cleaner to a revolving wet mop.

The above-identified cleaner can achieve an effect of a wet mop cleaning to a degree but it is difficult to remove the stains absorbed into the floor or the old dirt. Besides, there is a problem in that the cleaner not only reduces the cleaning efficiency due to a contamination of the cleaning water, thereby leaving behind stains after the cleaning, but also causes uncleanness in the sense of sanitation due to propagation of germs resulted from waste water not sucked in by the cleaner.

The present invention has been disclosed to solve the above-mentioned problems inherent in the conventional disclosures, and it is an object of the present invention to provide an electric vacuum cleaner which can generate from within the cleaner and eject high temperature steam to easily remove stains smeared into a floor, old dirt and the like, so that cleaning efficiency can be improved and a sterilizing function can be achieved as well.

It is another object of the present invention to provide an electric vacuum cleaner which can an even pressure of the steam generated from within the cleaner to thereby regulate the supplied quantity of the steam at a predetermined level, so that the cleaning operation can be conveniently performed.

SUMMARY OF THE INVENTION

In accordance with the object of the present invention equipped with a driving means for acquiring suction force, there is provided an elecric vacuum cleaner, which can perform a cleaning job with a wet cloth according to supply of steam to thereby improve the cleaning efficiency and achieve a sterilization and an efficiency of prevention of static electricity as well, comprising: a water supply means disposed in the body of the cleaner for storing a predetermined quantity of water therein; a steam generating means for generating steam by heating the water supplied from the water supply means; a dust collecting means for separating the dust and waste water according to the operation of the driving means to thereafter collect the same; and a suction head having a suction port for being assembled in the body of the cleaner to be formed therein and a steam ejection port for ejecting the steam generated from the steam generating means to a periphery of a revolving wet cloth.

BRIEF DESCRIPTION OF THE DRAWINGS

For a fuller understanding of the nature and objects of the invention, reference should be made to the following detailed description taken in conjunction with the accompanying drawings in which:

FIGS. 2 to 11*a*, 11*b* and 11*c* are drawings for illustrating a first embodiment of the present invention;

FIG. 2 is an overall longitudinal sectional view for illustrating an electric vacuum cleaner according to the first embodiment of the present invention;

FIG. 3 is a sectional fragmentary view for illustrating a partially enlarged water supply means in FIG. 2;

FIG. 4 is a sectional fragmentary view for illustrating a partially enlarged dust collecting means in FIG. 2;

FIG. 5 is a sectional fragmentary view for illustrating a partially enlarged driving means in FIG. 2;

FIG. 6 is a sectional fragmentary view for illustrating a partially enlarged first embodiment of the steam generating means in FIG. 2;

FIG. 7 is a transverse cross sectional view taken along line 7—7 in FIG. 6;

FIG. 8 is a view similar to FIG. 7 showing a modified heater;

FIG. 9 is a sectional view for illustrating a partially enlarged second embodiment of the steam generating means;

FIG. 10 is a sectional fragmentary view for illustrating a partially enlarged third embodiment of the steam generating means;

FIGS. 11*a*, 11*b* and 11*c* are sectional views for respectively illustrating modified suction heads;

FIG. 12 is an overall longitudinal sectional fragmentary view for illustrating an electric vacuum cleaner according to the second embodiment of the present invention;

FIG. 13 is a sectional fragmentary view for illustrating a partially enlarged important element shown in FIG. 12;

FIG. 14 is a partially enlarged sectional fragmentary view for illustrating a modified water control means according to the present invention; and FIG. 15 is an enlarged sectional fragmentary view for illustrating the steam generating means according to the present invention.

DETAILED DESCRIPTION OF THE PREFERRED EMBODIMENTS OF THE INVENTION

Hereinafter, the first embodiment of the present invention will be described in detail with reference to the accompanying drawings from FIG. 2 to FIG. 13.

Figure 1:
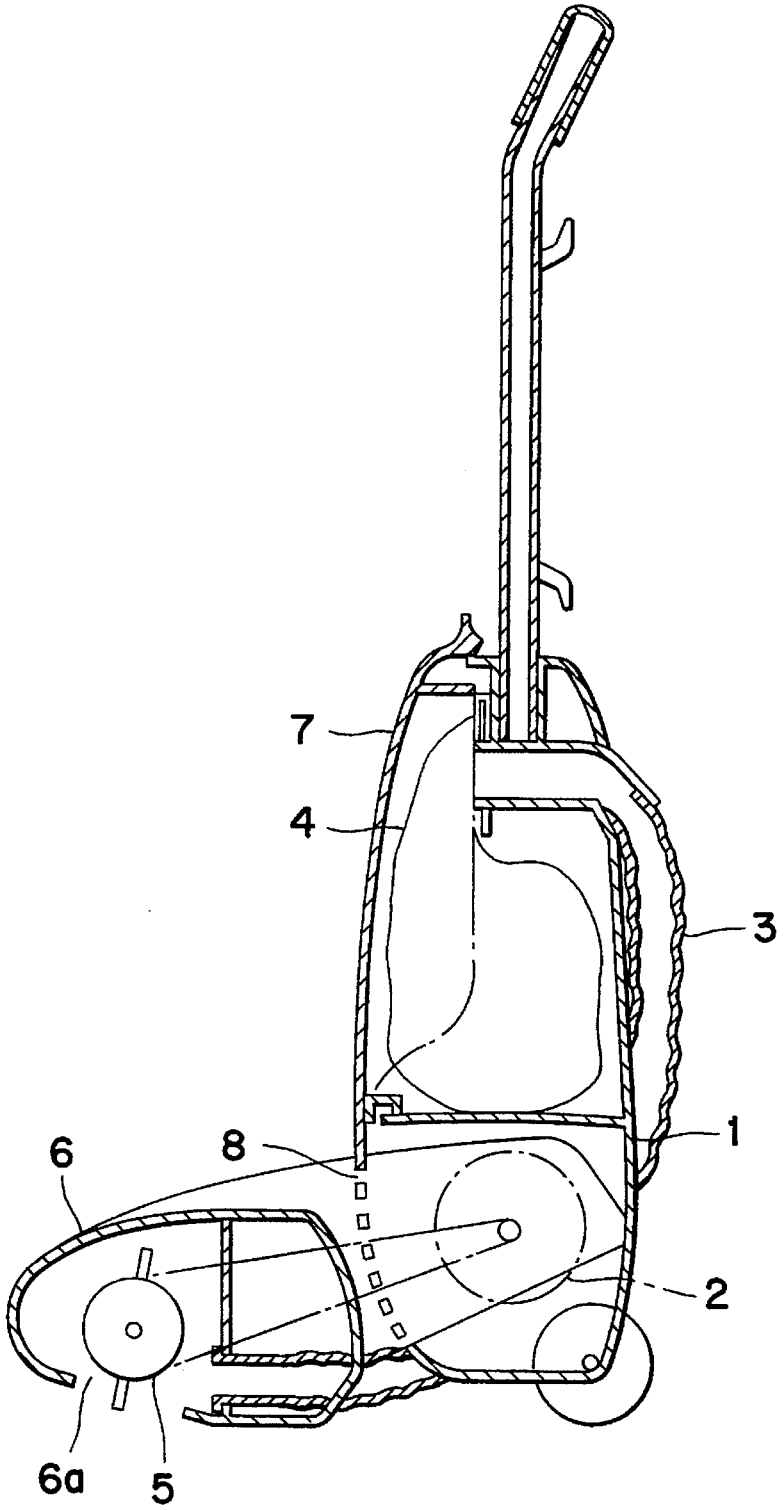
FIG. 1 (PRIOR ART)
FIG. 1 is an overall longitudinal sectional view for illustrating a conventional upright electric vacuum cleaner.
Figure 2:
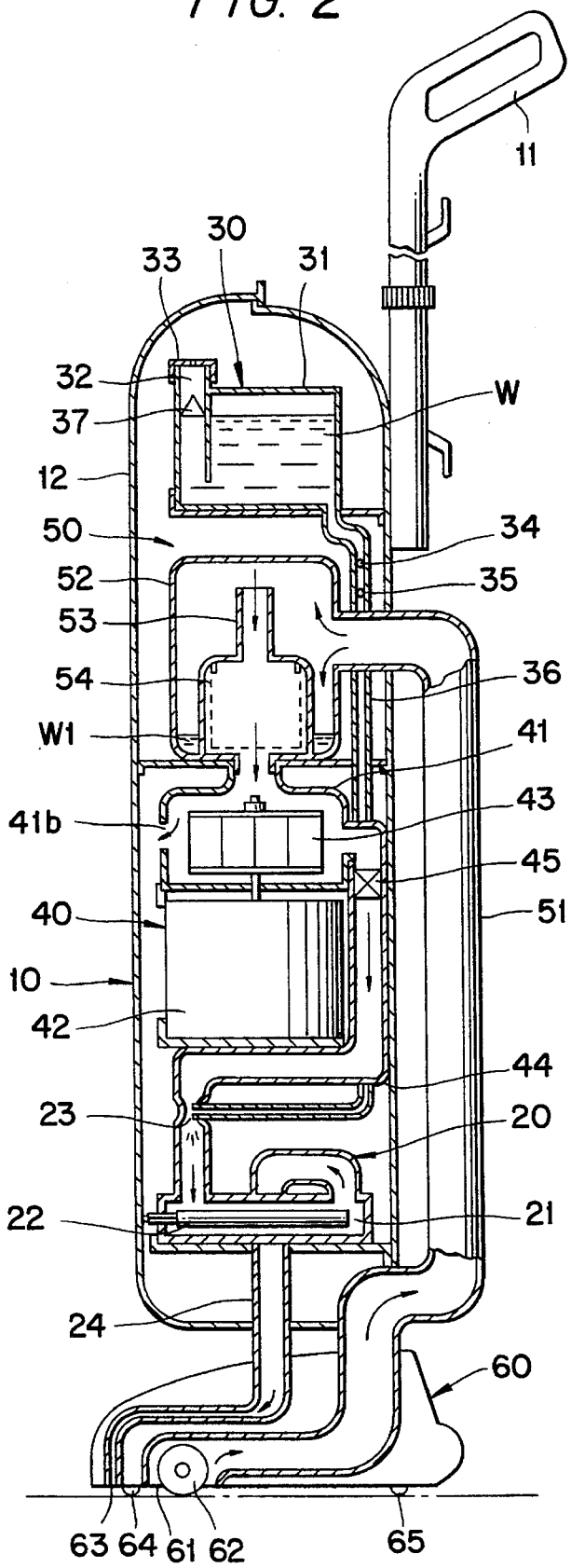

FIG. 2 is a sectional view for illustrating an electric vacuum cleaner according to the first embodiment of the present invention, where reference numeral 10 represents a housing or body of the cleaner having a handle 11 coupled to one side thereof and a cover 12 detachably coupled to a front thereof.

The body 10 is coupled to a steam generating means 20 for generating steam according to operation of the cleaner, and is coupled to a water supply means 30 for supplying water W into the steam generating means 20.

Figure 3:
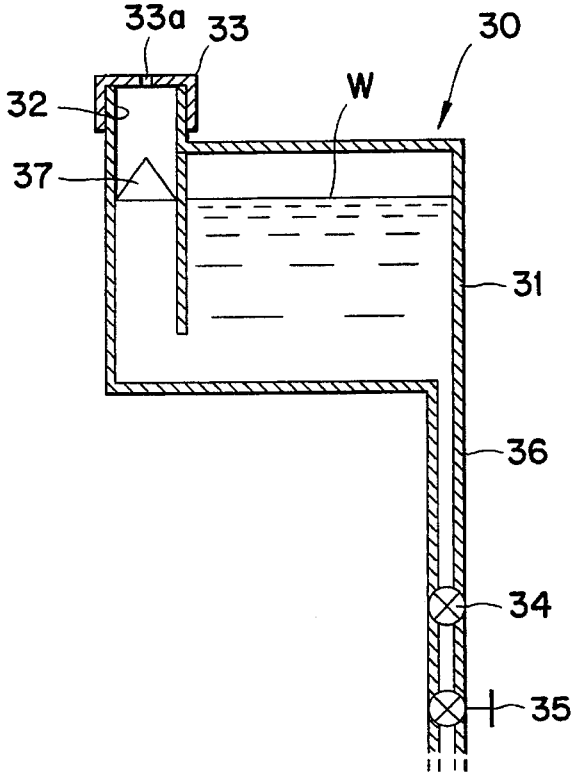

The water supply means 30, as illustrated in FIG. 3, includes a water storage tank 31 for storing a predetermined quantity of water W therein, upon which there is formed a water filling port 32 for water refilling.

The water filling port 32 is closed by a screw-threaded lid 33 formed with an orifice 33*a* for air circulation.

A water pipe 36 is connected at a lower side of the water storage 31 tank and carries a check valve 34 for prevention of water W counterflow and a flow control valve 35 for controlling quantity of water W that is supplied.

A float 37 is disposed within the water storage tank 31 in order to prevent the water W from overflowing.

Meanwhile, a dust collecting means 50 is disposed under the water supply means 30, which collects the dust and the like sucked in by suction force generated by activation of a driving means 40.

Figure 4:
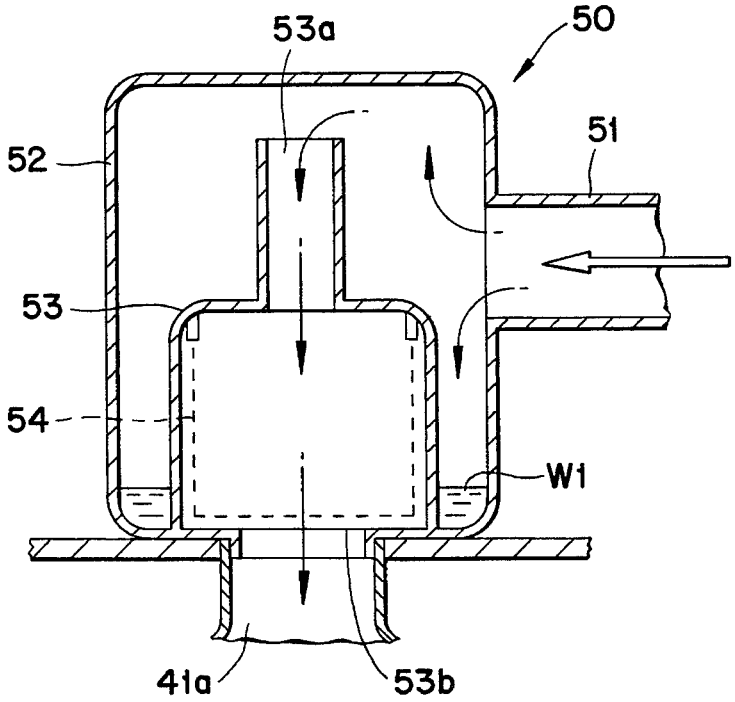

The dust collecting means, as illustrated in FIG. 4, separates the dust and the waste water sucked in by the suction head 60 connected to the lower side of the body 10 and by a suction pipe 51 connected therebetween to thereafter store the same separately.

The waste water W1 sucked in from the suction pipe 51 can be stored in a waste water storage tank 52, detachably connected to an upper side of the driving means 40 because of the presence of a filter box 53 integrally formed therewith.

The filter box 53 is formed with a suction port 53*a* for sucking in the air and the dust infused into the waste water storage tank 52.

The filter box 53 detactably carries a filter 54 for storing the sucked-in dust and the filter box is formed with a discharge port 53*b* for discharging the air which has passed the filter 54.

It is advisable that the filter should be formed as a mesh pouch, through which the air can pass but the dust cannot pass. When the mesh pouch is filled with the dust, the filter and dust can be taken out through the discharge port 53*b* formed under the filter box 53.

Figure 5:
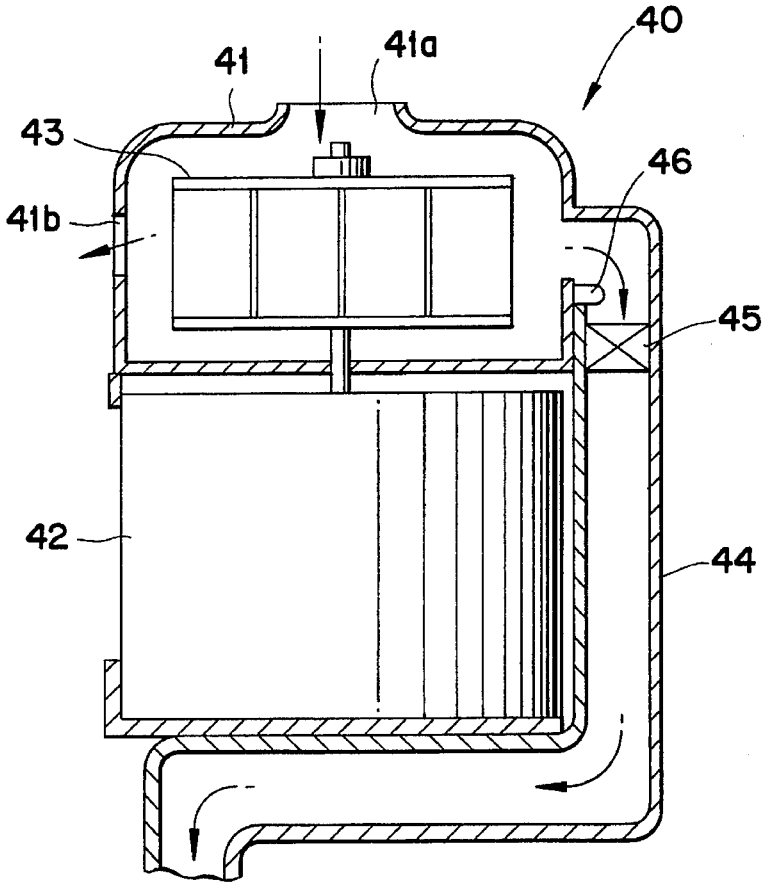

Meanwhile, the driving means 40 disposed under the dust collecting means 50, as illustrated in FIG. 5, is housed in a housing 41 connected to the waste water storage tank 52 and includes a rotary impellor 43 for generating suction force by being rotated according to the activation of a driving motor 42 installed in the housing 41 under the impeller.

A suction port 41*a* connected to the discharge port 53*b* is formed on an upper side of the housing 41 for air circulation and at the same time, an exhaust port 41*b* is formed at one side thereof in order to discharge part of the purified air sucked in from the suction port 41*a*.

A discharge pipe 44 is connected to the other side of the housing 41 in order to supply the purified air into the steam generating means 20.

An exhaust valve 45 is disposed in the discharge pipe 44 in order to discharge the purified air within the housing 41 according to a valve opening and closing operation.

A pressure sensor 46 is disposed above the valve 45 in order to control an opening degree of the exhaust valve according to pressure within the housing 41.

Figure 6:
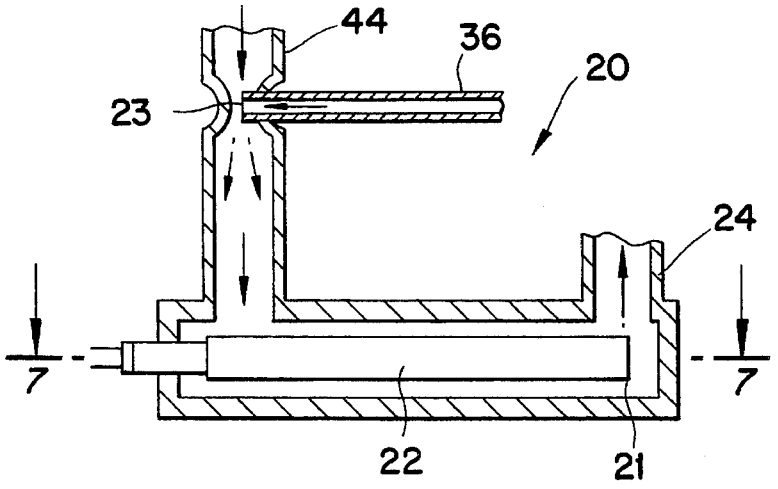
Figure 7:
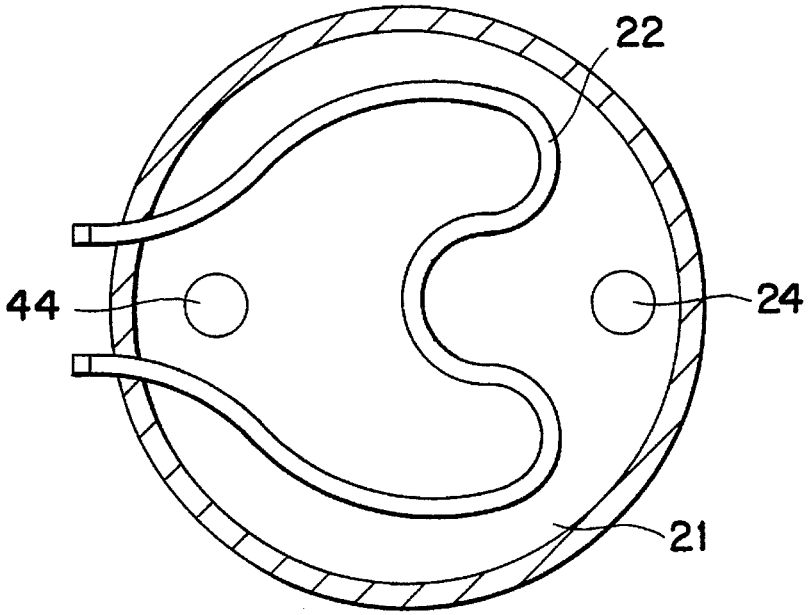

Meanwhile, the steam generating means 20 disposed under the driving means 40 for generating steam by being supplied with water W from the water supply means 30, as illustrated in FIGS. 6 and 7, is provided with a heater 22 in a steam chamber 21 for generating heat, and an exhaust pipe 44 is connected to one side of the chamber 21 in order to feed in purified air.

The exhaust pipe 44 is connected to a water supply pipe 36 and is formed with an ejection nozzle 23 of a small diameter for ejecting water W atomized by pressure of the purified air. A steam exhaust pipe 24 is connected to the other side of the steam chamber 21 in order to discharge steam.

The water W in the ejection nozzle 23 supplied through the supply pipe 36 is ejected into the steam chamber 21 in the atomization state by the pressure of the air discharged from the exhaust pipe 44 to thereby shorten the heating time and facilitate the generation of steam.

Figure 8:
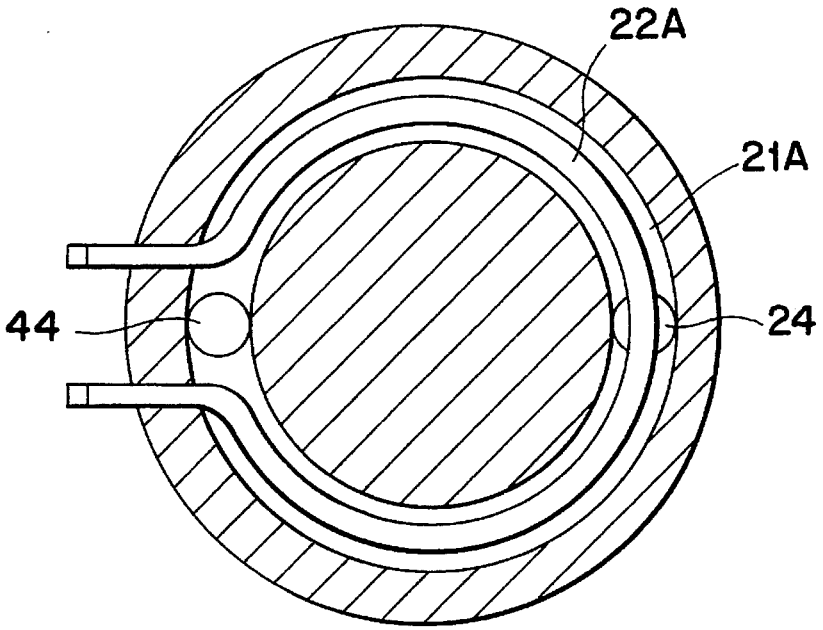

Here, the shapes of the steam chamber 21 and the heater 22 are not limited to the present embodiment. As illustrated in FIG. 8, the steam chamber 21A can be made in a ring shape with a similarly shaped heater 22A installed therein to thereby improve heat efficiency of the heater 22 and further facilitate the generation of the steam.

Figure 9:
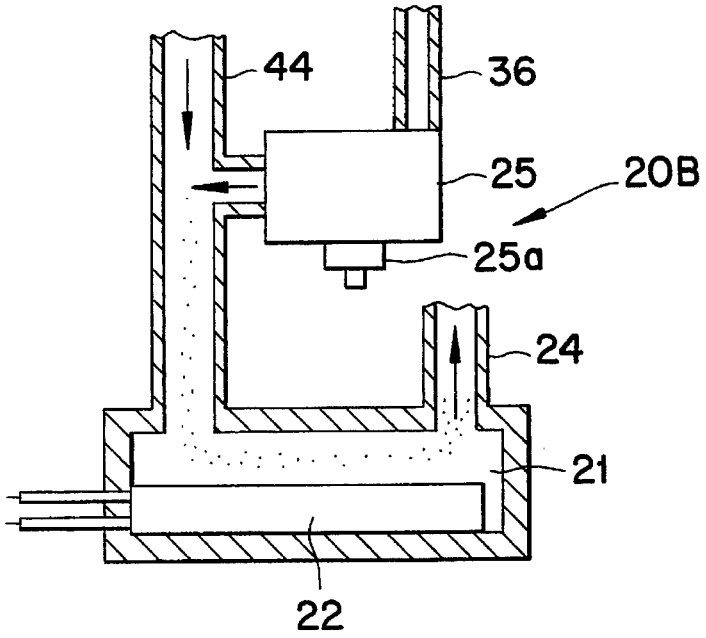

Meanwhile, the steam generating means 20 is not limited to the present embodiment, and by way of example, as illustrated in FIG. 9, the water supply pipe 36 of the steam generating means 20B can be provided with an ultrasonic humidifying means 25 having a trembler 25*a* to thereby atomize the water W supplied from the water supply means 30 and to thereafter supply the same along with the purified air into the steam chamber 21.

Figure 10:
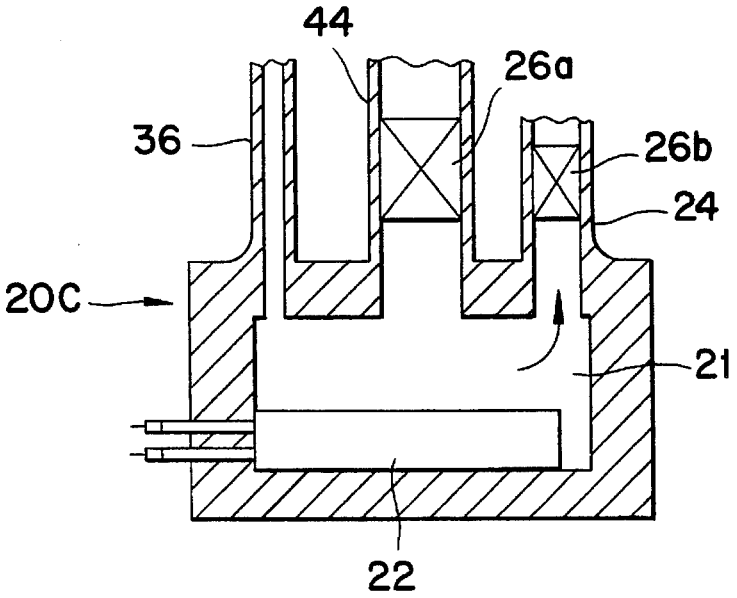

Furthermore, in a steam generating means 20C illustrated in FIG. 10, the water supply pipe 36 and the exhaust pipe 44 are connected to the steam chamber 21. A liquid stream of water will enter the chamber 21 through the pipe 36 and be converted to steam by the heater 22. Then, the steam becomes entrained in the air received from pipe 44 to travel therewith through the pipe 24, in accordance with the closing and opening of respective valves 26*a* and 26*b* installed within the exhaust pipe 44 and steam exhaust pipe 24.

In other words, the steam within the steam chamber 21 cannot receive air from the steam exhaust pipe 24 when the valves 26*a* and 26*b* are closed to thereby prevent the discharge of the steam, and when the valves 26*a* and 26*b* are opened, the steam is discharged into the suction head 60 through the steam exhaust pipe 24 by pressure of the air discharged from the exhaust pipe 24 according to the activation of the driving means 40.

At this time, because the valves 26*a* and 26*b* are systematically operated along with the flow control valve 35 disposed in the water supply pipe 36, the discharged quantity of the water, air and the steam can be controlled.

Figure 11A:
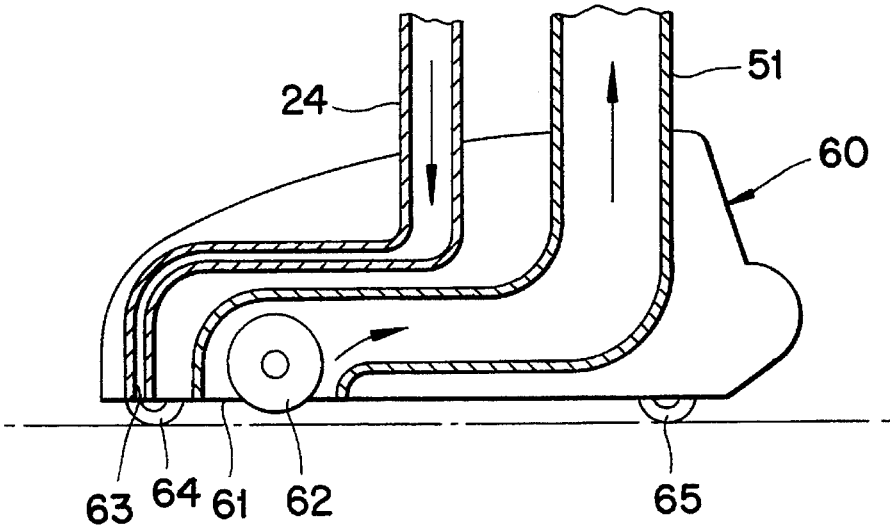
Figure 11B:
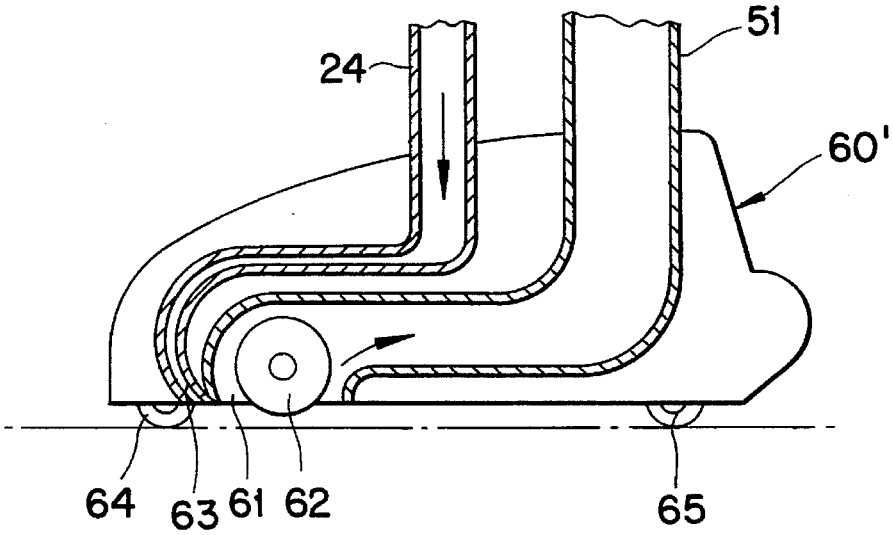

Meanwhile, the suction head 60 installed at the bottom of the body 10 of the cleaner, as illustrated in FIG. 11A, includes a suction pipe 51 connected to the dust collecting means 50 at the other end thereof, and one end of which is formed with a suction port 61 facing the floor in order to absorb the dust, foreign objects and the waste water.

Within the suction port 61, a revolving cloth 62 is rotatively disposed in order to effect a wet cloth cleaning action. A steam ejection port 63 for ejecting steam generated from the steam generating means 20 is connectedly formed with the steam exhaust pipe 24.

Figure 11C:
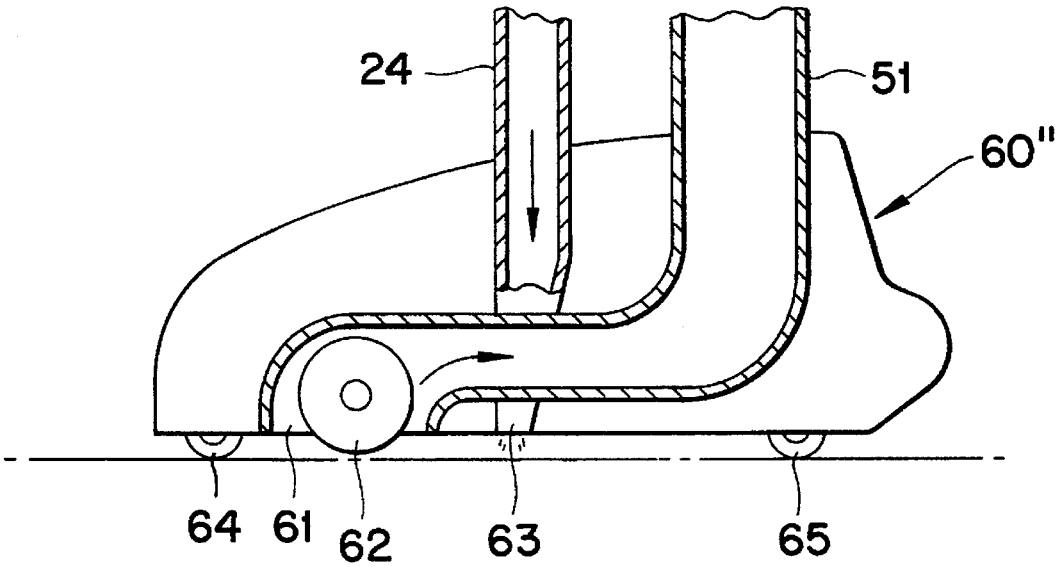

Instead of the steam ejection port 63 facing the floor at a front of the suction port 61, the steam ejection port 63 can be positioned to face the suction port 61 (see the modified suction head 60' in FIG. 11B) to thereby eject the steam directly to a periphery of the revolving cloth 62, or the steam injection port can be positioned behind the suction port 61 as illustrated in connection with the modified suction head 60" of FIG. 11C.

A front wheel 64 and a rear wheel 65 are rotatively connected to the lower side of the suction head 60.

Hereinafter, the operation and effect of the first embodiment according to the present invention thus constructed will be described in detail.

First of all, when the suction force is generated within the dust collecting means 50 according to the activation of the driving means 40, foreign objects such as the dust and the like are sucked in through the suction port 61 formed at the suction head 60, and at the same time, the water W supplied from the water supply means 30 is evaporated at the steam generating means 20 to thereafter be ejected toward the to-be-cleaned floor through the steam ejection port 63.

In other words, when the impellor 43 is rotated according to activation of the driving motor 42, a strong suction force is generated in the dust collecting means 50, and the foreign objects such as the dust and the like absored into the suction port 61 are sucked into the waste water storage tank 52 through the suction pipe 51.

The water W stored in the storge 31 tank of the water supply means 30 is dispatched to the steam chamber 21 through the water supply pipe 44.

The water W is then atomized at the ejection nozzle 23 by air pressure supplied by the impellor 43 to thereby be sent to the steam chamber 21. The exhaust pipe 44 and water supply pipe 36 are joined at the ejection nozzle 23.

At this time, the check valve 34 prevents the water W from flowing backward.

Furthermore, because the lid 33 is screwed to the upper side of the storage tank 31, the water W can be refilled. The lid 33 is formed with an orifice 33*a* for air circulation, so that pressure of the water W discharged through the water supply pipe 36 can be maintained at a predetermined level. The float 37 disposed therein prevents the water W in the storage tank 31 from overflowing or undulating.

If an ultrasonic humidifying means 25 (FIG. 9) for generating ultrasonic waves according to operation of the trembler 25*a* is installed in the water supply pipe 36, the atomization is further smoothed. When the opening degrees of the respective valves 26*a* and 26*b* are controlled and the steam chamber 21 is connected to the exhaust pipe 44 and the water supply pipe 36, the supply of water W and discharge of the steam can be managed.

The atomized water W dispatched to the steam chamber 21 is thereafter heated by the heater 22 and is ejected to the steam ejection port 63 formed at the suction head 60 through the steam exhaust pipe 24. The air-water mixture travels around a corner to reach the heater, and the resultant turbulence aids in establishing contact between the water vapor and heater. Immediately upon start-up, condensation of the steam in conduit 24 will occur, but such condensation substantially stops once the tube warms up.

Accordingly, the steam ejected into the steam ejection port 63 is now ejected to the to-be-cleaned floor in a high temperature state to thereby perform sterilization and at the same time, to make it possible to perform separate cleaning of the stains, old dirt and the like by way of operation of the revolving wet cloth 62.

At this time, according to the operation of the revolving wet cloth 62, the collected waste water W1 is sucked into the waste water storage tank 52 along with the dust.

In other words, when the steam is supplied to the periphery of the cloth 62 through the steam ejection port 63, the cloth 62 is rotatively operated to thereby perform the wet cloth cleaning, and at the same time, foreign objects smeared into the floor can be removed to thereafter be sucked into the suction port 61 along with the dust and the waste water.

The waste water W1 sucked into the waste water storge tank 52 is dropped to an inner floor thereof to thereby be stored, and the air inclusive of the dust is sucked into the tank through a filter entrance 53*a* formed at an upper side of the filter box 53.

Subsequently, because the foreign objects such as the dust and the like sucked into the filter box 53 cannot pass through the filter 54 to thereby be stored therein, the purified air which has passed the filter 54 is sucked into the housing 41 through a filter exit 53*b* by pressure according to the operation of the impellor 42.

Part of the air sucked into the housing 41 is discharged to an outside of the body 10 of the cleaner through the exhaust port 41*b* formed at one side thereof and the balance of the air is discharged to the steam generating means 20 through the exhaust pipe 44.

At this time, because the exhaust valve 45 is controlled by a pressure sensor 46, an even pressure of air is constantly supplied into the exhaust pipe 44.

Meanwhile, when the steam generated by the steam generating means 20 is ejected through the steam ejection port 63 formed under the suction head 60, the steam is ejected to the periphery of the revolving wet cloth 62, to thereby achieve a wet cloth cleaning.

Quantity of steam discharged through the steam ejection port 63 can be controlled by a proper control of the flow control valve 35 disposed within the water supply pipe 36 and the exhaust valve 45 disposed within the exhaust pipe 44.

Accordingly, if only the driving means 40 is activated without operation of the steam generating means 20, the dust and the like sucked into the suction pipe 51 are stored within the filter 54 and the air is discharged through the exhaust port 41*b* formed at the housing 41 to thereby perform a dry cleaning. If the steam generating means 20 is operated to thereby eject the steam to the periphery of the cloth 62 and the suction port 61, a wet cloth cleaning of the stains, old dirt and the like can be possible, in addition to prevention of a static electricity phenomenon according to maintenance of proper humidity and at the same time, dry cleaning for performing the sterilization function.

If the water W supply is stopped by the flow control valve 35 becoming closed before the cleaning is finished, the floor can be dried by the heat generated by the heater 22 to thereby obtain an effect of much improved cleaning condition.

A second embodiment of the electric vacuum cleaner according to the present invention will be described in detail with reference to FIGS. 12, 13, 14 and 15.

The elements in FIGS. 12–15 which correspond to those of FIGS. 1–11 will have the same reference numerals, with the suffix "D".

Figure 12:
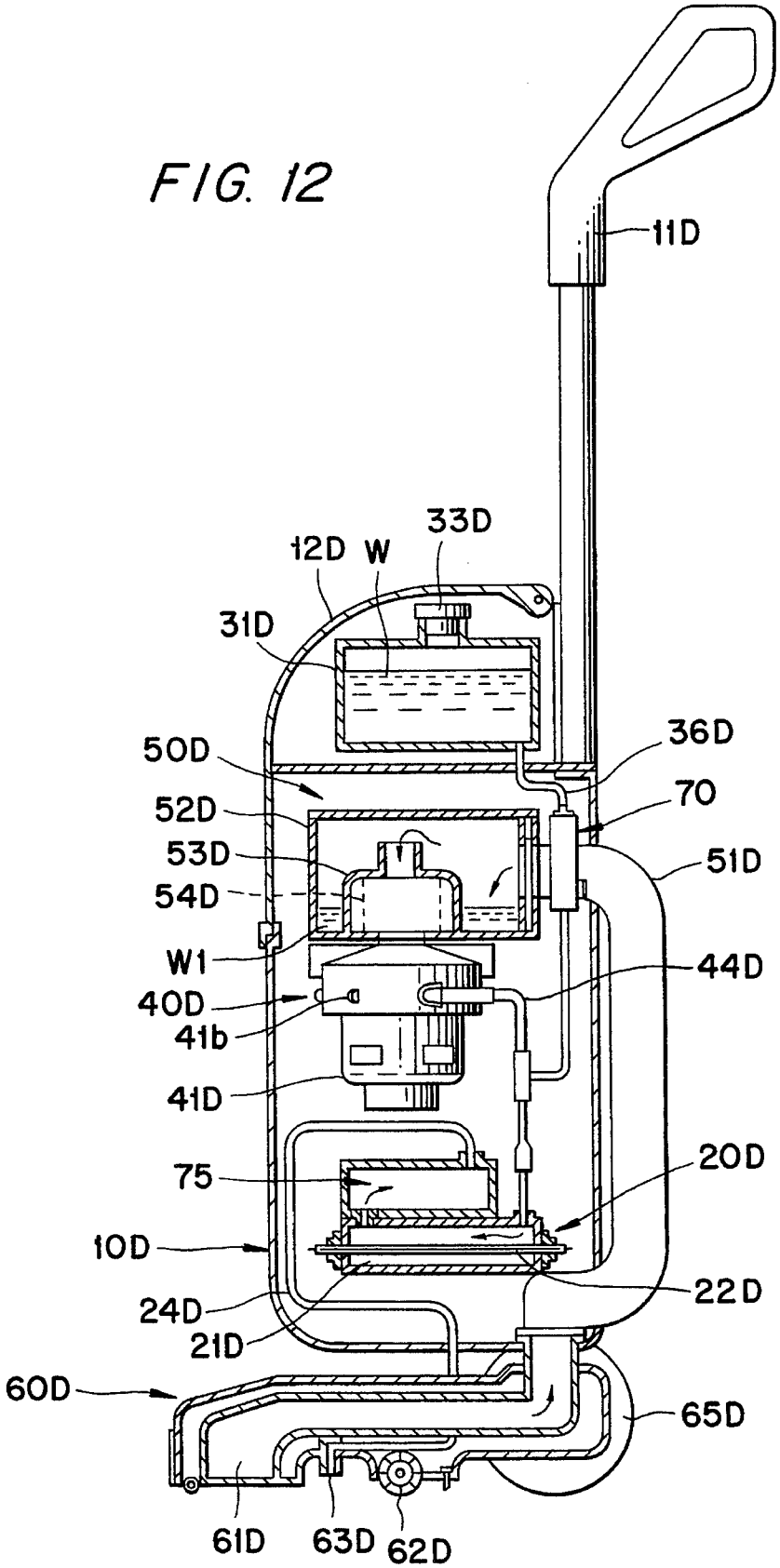
FIGS. 12, 13, 14 and 15 are drawings for illustrating a second embodiment of the present invention.
Figure 13:
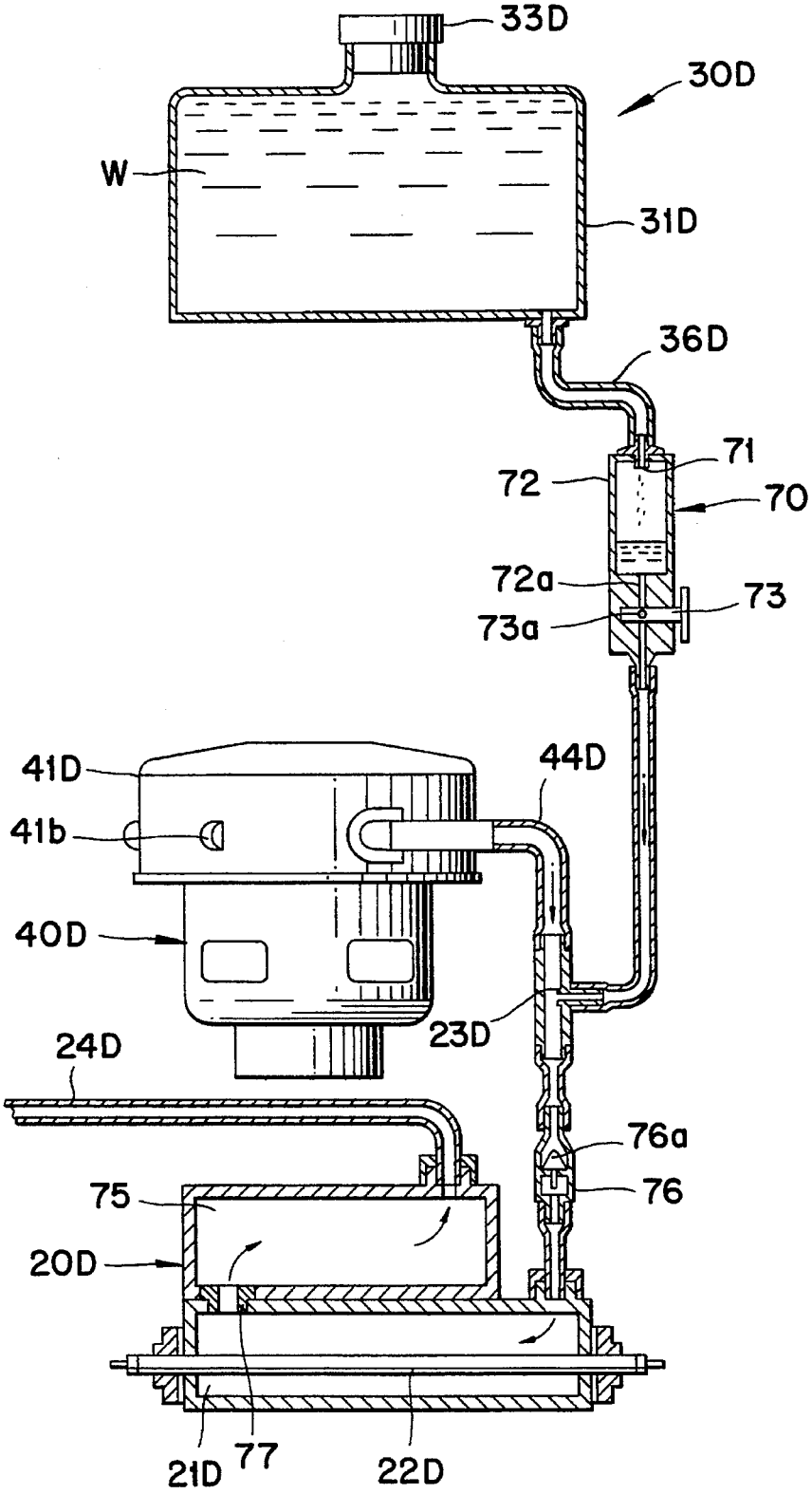

In FIGS. 12 and 13, the water supply pipe 36D connected to the exhaust pipe 44D at a tip thereof is connected to the storage tank 31D at one side thereunder where the water W is stored therein, and a water supply control means 70 for controlling the quantity of supplied water W is disposed at the water supply pipe 36D.

The water supply control means 70 is connected at an upper side thereof to a minute (thin) pipe 71 for supplying a quantity of water W from the storage tank 31D, and a storage chamber 72 is formed under the minute pipe 71 for the temporary storage of water W and for the maintenance of a constant pressure thereof.

A control valve 73 is disposed at a passage 72*a* formed under the storage chamber 72 in order to control the quantity of water W passing through the inner parts of the passage 72*a*.

An orifice is provided with a control valve 73 for controlling the quantity of water W supplied by way of opening and closing of a passage 72*a* connected to the storage chamber 72.

Figure 14:
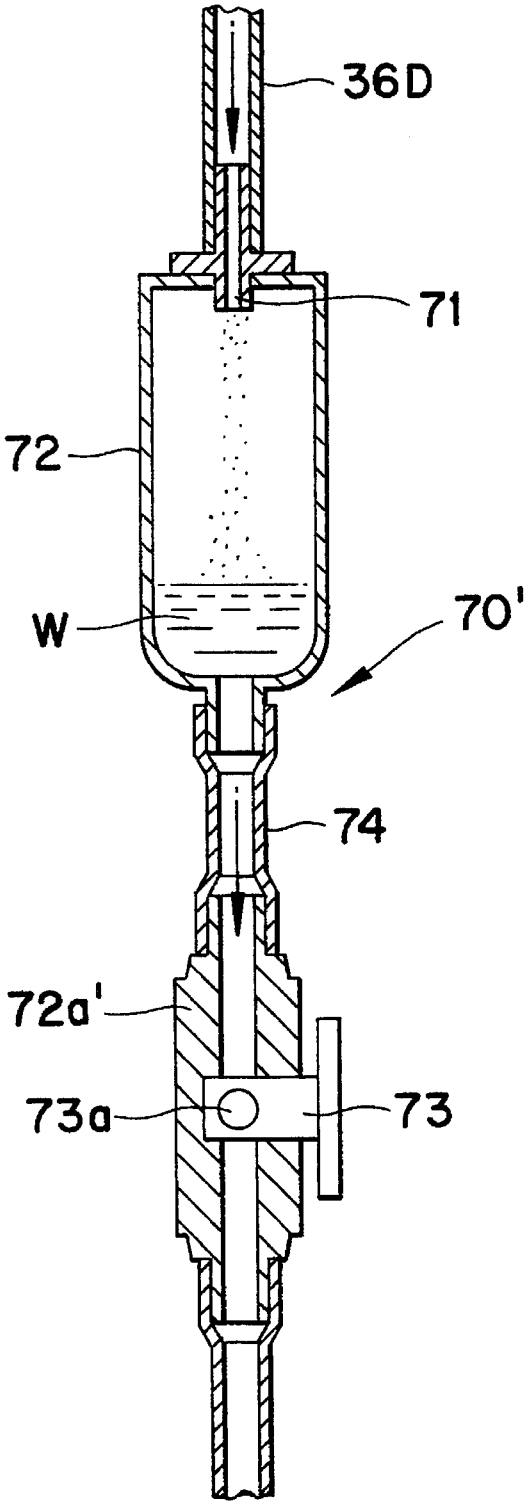

The water supply control means 70 is integrally formed with the passage 72*a*. Alternatively, as illustrated in FIG. 14, the storage chamber 72' and the passage 72*a*' can be separately formed, between which a connecting pipe 74 can be disposed to thereby control the quantity of water W supplied from the storage tank 31D.

Figure 15:
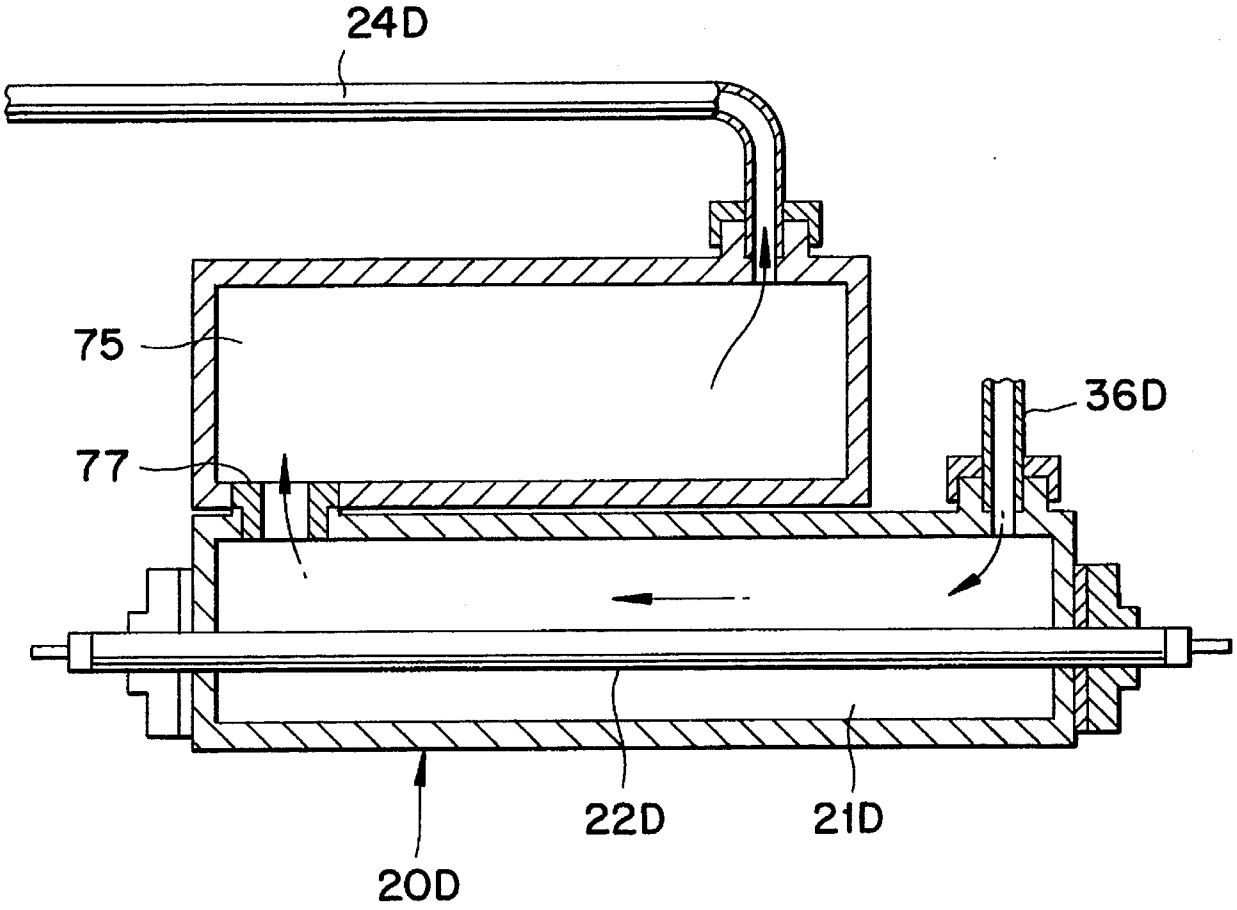

Meanwhile, a steam pressure regulator in the form of a buffering chamber 75 is formed at the upper side of the steam chamber 21D, as illustrated in FIG. 15, in order to temporarily store the steam generated by the heating by the heater 22 and at the same time, to evenly maintain pressure of steam discharged from the exhaust pipe 24D.

A nonreturn valve 76 is disposed in the exhaust pipe 44 in order to prevent the steam in the steam chamber 21D from flowing backward through the exhaust pipe 44D.

The nonreturn valve 76 prevents the counterflow of the steam by closing down the exhaust pipe 44D as the steam in the steam chamber 21D flows backward to thereby raise a valve member 76*a* by the pressure of the steam.

A connecting pipe 77 connects connecting the steam chamber 21 and the steam pressure buffering chamber 75.

Accordingly, when the suction force is generated by the driving means 40D, the water W supplied through the water supply pipe 36D is ejected by the air discharged from the exhaust pipe 44D to therby be atomized for supply to the steam chamber 21D. The atomized water W supplied to the steam chamber 21D is evaporated by heating of the heater 22D to thereby be infused into the steam pressure buffering chamber 75.

At this time, the steam discharged to the steam pressure buffering chamber 75 is ejected therefrom under a constant pressure into the steam ejection port 63D through the steam exhaust pipe 24D. The water W not discharged from the steam pressure buffering chamber 75 and condensed therein is re-heated by the heat conducted from the steam chamber 21D and then is evaporated again, so that genuine steam not mixed with the water W can be supplied to the steam ejection port 63D.

Because a minute quanity of water W is evenly supplied through the minute pipe 71 into the storage chamber 72 at the water supply control means 70, the pressure of water is not only uniformly maintained, but the quantity of water W supplied through the orifice 73*a* of the control valve 73 can be evenly maintained.

Furthermore, the orifice 73*a* becomes opened when aligned with the passage 72*a* according to the operation of the control valve 73*a* and when the orifice 73*a* is not aligned with the passage 72*a*, the orifice 73*a* becomes closed to thereby facilitate the control of the quanity of water W supplied to the steam generating means 20.

The nonreturn valve 76 disposed in the exhaust pipe 44D closes the exhaust pipe 44D when the steam within the steam chamber 21D is flowed backward by inner pressure therein to thereby raise the valve member 76*a* disposed at the inner side thereof, so that the counter flow of the steam can be prevented.

Accordingly, the water W supplied from the storage tank 31D is heated by the steam generating means 20D to thereafter be evaporated, and when the steam is infused again into the steam pressure buffering chamber 75, the steam is temporarily stored therein to thereby be ejected under a predetermined pressure through the steam ejection port 63D of the suction head 60D, so that the quantity of steam supplied to the periphery of the cloth member 62D can be uniformly maintained at all times for easy and even wet cloth cleaning.

Furthermore, the steam heated to high temperature in the steam generating means 20D is ejected into the steam ejection port 63D to thereby perform not only a sterilization but also the maintenance of appropriate humidity, and prevention of a static electricity phenomenon as well.

As seen from the forgoing, the electric vacuum cleaner according to the present invention can eject high temperature steam to the revolving cloth and a periphery of the suction port to thereby perform a sterilization operation and prevent a static electricity phenomenon.

The electric vacuum cleaner according to the present invention also performs a wet cloth cleaning to thereby facilitate cleaning action of stains, old dirt and the like.

Accordingly, the electric vacuum cleaner according to the present invention further improves the cleaning efficiency, and according to the selection of a supply or a stoppage of water, dry cleaning or wet cleaning can be selectively performed to thereby make it possible to use the cleaner in a most convenient way.

Furthermore, because the quantity of the supplied water and the amount of ejected steam are uniformly achieved, steam can be easily generated and the wet cloth cleaning can be further facilitated as well.

Having described specific preferred embodiments of the invention with reference to the accompanying drawings, it is to be understood that the invention is not limited to those precise embodiments, and that various changes and modifications may be effected therein by one skilled in the art without departing from scope or spirit of the invention as defined in the appended claims.

What is claimed is:

1. An electric vacuum cleaner comprising:

a housing;

a water supply tank disposed in the housing for storing clean water;

a steam generator disposed in the housing and communicating with the water supply tank for receiving water therefrom, and including a heater for converting the received water into steam;

a suction generator disposed in the housing for generating suction;

a suction port communicating with the suction generator for sucking in a mixture of dirt, air and steam;

a dirt collector connected to the housing and communicating with the suction port for separating dirt from air and moisture in the mixture received from the suction port;

wherein the water supply tank being provided with an openable lid on an upper side thereof, a water supply conduit interconnecting the water supply tank with the steam generator;

a flow control valve disposed in the water supply conduit, and a check valve disposed in the water supply conduit for preventing a backflow of water toward the water supply tank;

the steam generator being provided with a steam chamber in which the heater is disposed, the steam chamber including inlet means for receiving water from the water supply tank and air from an outlet side of the suction generator;

an inlet side of the suction generator connected to an outlet side of the dirt collector such that air exhausted from the dirt collector is supplied to the steam chamber;

a steam discharge port communicating with the steam generator for discharging steam toward a floor; and a cloth mounted for revolving movement to wipe against the floor.

2. The electric vacuum cleaner according to claim 1 wherein the water supply conduit is connected to the inlet means such that water introduced into the inlet means is atomized by air from the suction generator flowing through the inlet means.

3. The electric vacuum cleaner according to claim 1, wherein the steam chamber includes separate air and water inlets for air and water, the air inlet being valved, a steam discharge conduit connecting the steam chamber to the steam discharge port; and a valve disposed in the steam discharge conduit.

4. An electric vacuum cleaner according to claim 1, further including a pressure regulator in the form of a steam buffering chamber communicating with a steam outlet of the steam chamber for producing a uniform steam pressure supplied to the steam discharge port.

5. An electric vacuum cleaner according to claim 1, further including an ultrasonic vibrator disposed in the water supply conduit for atomizing water traveling through the water supply conduit.

6. The electric vacuum cleaner according to claim 1, wherein the dirt collector includes a waste water storage tank communicating with the suction port and a filter box disposed in the waste water storage tank and containing a detachable filter for storing the sucked-in dust, the waste water storage tank being provided at a bottom portion thereof with a discharge port for discharging air which has passed the filter.

7. The electric vacuum cleaner according to claim 1, further including a water pressure controller for maintaining a constant pressure on water supplied to the steam generator.

8. The electric vacuum cleaner according to claim 7, wherein the pressure controller comprises a storage chamber connected by a first conduit to the water supply tank, the volume of the storage chamber being less than the volume of the storage tank, and a valved second conduit extending from the storage chamber to the steam generator.

9. An electric vacuum cleaner comprising:

a housing;

a water supply tank connected to the housing for storing clean water;

a suction generator connected to the housing for generating suction; the suction generator having a suction inlet and an air outlet;

a steam generator connected to the housing and including:

a steam chamber, a heater in the steam chamber for converting water into steam, an inlet conduit communicating the air outlet of the suction generator with the steam chamber for introducing an air flow into the steam chamber, and a water conduit extending from the water supply tank to the inlet conduit to mix water with the air to atomize the water introduced to the steam chamber;

a suction head connected to the housing and including at its underside:

a steam discharge port communicating with the steam chamber for discharging steam toward a floor, and a suction port communicating with the suction inlet of the suction generator for sucking-in a mixture of dirt, air and steam; and a dirt collector connected to the housing and communicating with the suction port of the suction head for separating dirt from air and moisture in the mixture received from the suction port.

10. The electric vacuum cleaner according to claim 9, wherein the inlet conduit includes a restriction, the water supply conduit communicating with the inlet conduit at the restriction.

11. The electric vacuum cleaner according to claim 9, wherein the water supply tank, suction generator, steam generator, suction head, and dirt collector are disposed inside of the housing.

12. The electric vacuum cleaner according to claim 9, wherein the suction inlet is connected to an air outlet of the dirt collector so that air exiting the dirt collector is delivered to the steam chamber through the suction generator and the inlet conduit.

* * * * *